US006719176B2

(12) United States Patent
Sahai

(10) Patent No.: US 6,719,176 B2
(45) Date of Patent: Apr. 13, 2004

(54) METHOD AND APPARATUS FOR CONTROLLING STANDING SURFACE WAVE AND TURBULENCE IN CONTINUOUS CASTING VESSEL

(75) Inventor: Yogeshwar Sahai, Powell, OH (US)

(73) Assignee: The Ohio State University, Columbus, OH (US)

( * ) Notice: Subject to any disclaimer, the term of this patent is extended or adjusted under 35 U.S.C. 154(b) by 31 days.

(21) Appl. No.: 09/966,734

(22) Filed: Sep. 28, 2001

(65) Prior Publication Data

US 2002/0070487 A1 Jun. 13, 2002

Related U.S. Application Data

(63) Continuation-in-part of application No. 09/698,858, filed on Oct. 27, 2000, now Pat. No. 6,543,656.

(51) Int. Cl.[7] ..... B22D 41/08
(52) U.S. Cl. ..... 222/594; 222/606; 164/437
(58) Field of Search ..... 222/590, 594, 222/606, 607; 164/437

(56) References Cited

U.S. PATENT DOCUMENTS

| | | | | |
|---|---|---|---|---|
| 3,669,181 A | * | 6/1972 | Schrewe | 164/437 |
| 4,015,655 A | * | 4/1977 | Fastner et al. | 164/437 |
| 4,160,387 A | | 7/1979 | Ihara et al. | 73/639 |
| 4,457,356 A | | 7/1984 | Hasebe et al. | 164/478 |
| 4,590,989 A | | 5/1986 | Kobayashi | 164/504 |
| 4,819,840 A | | 4/1989 | Lax et al. | |
| 4,858,794 A | | 8/1989 | Sugiura et al. | |
| 4,993,477 A | | 2/1991 | Praeg | 164/453 |
| 5,307,863 A | | 5/1994 | Kubota et al. | 164/466 |
| 5,375,648 A | | 12/1994 | Idogawa et al. | 164/471 |
| 6,543,656 B1 | * | 4/2003 | Sahai | 222/594 |

FOREIGN PATENT DOCUMENTS

| | | | |
|---|---|---|---|
| JP | 63076753 A | | 7/1988 |
| WO | WO 95/30500 | * | 11/1995 |

* cited by examiner

*Primary Examiner*—Scott Kastler
(74) *Attorney, Agent, or Firm*—Nixon & Vanderhye

(57) ABSTRACT

The apparatus of the present invention includes a molten metal vessel system for casting molten metal, the system comprising: (a) a vessel containing a molten metal adapted to contain and dispense the molten metal for casting, the vessel having interior surfaces and the molten metal forming an upper surface; (b) a submerged entry nozzle extending below the upper surface; and (c) a surface and/or a submerged flow modifier member disposed between at least one of the interior surfaces and the submerged entry nozzle. The surface and/or submerged flow modifiers work to impede the formation of waves in the upper surface of the molten metal. The present invention also includes a method for improving the quality of a continuous casting process.

26 Claims, 12 Drawing Sheets

METHOD AND APPARATUS FOR CONTROLLING STANDING SURFACE WAVE AND TURBULENCE IN CONTINUOUS CASTING VESSEL

This application is a continuation-in-part of U.S. patent application Ser. No. 09/698,858, filed on Oct. 27, 2000, now U.S. Pat. No. 6,543,656.

TECHNICAL FIELD OF THE INVENTION

The present invention is in the field of continuous steel casting.

BACKGROUND OF THE INVENTION

In continuous casting of steel, molten metal is poured from a large vessel called a "Tundish" into a water-cooled copper mold by using a submerged entry nozzle ("SEN"). Steel begins to solidify as it comes in contact with the walls of the copper mold, the slab descending down continuously at the casting rate. The thickness in a slab caster mold typically is about 9 to 12 inches, whereas in a thin slab caster the thickness is only about 2 to 4 inches. The width of the slab is generally very large, typically 60 to 72 inches. A layer of mold flux is maintained at the free surface of the metal, which protects the hot metal from atmospheric oxidation and provides a thin lubricating layer between the descending slab and the mold walls.

Several fluid flow studies of slab caster molds have shown that the flow of molten metal in a mold has a large influence on the surface and subsurface quality of the resultant cast metal. The molten metal exiting the submerged entry nozzle is at an angle relative to the horizontal and impinges on the narrow wall. This results in the formation of upper and lower recirculating flows, which are schematically shown in a general flow pattern in FIG. 1. The upper recirculation causes a standing wave at the free surface. The height of the wave typically oscillates with time. This oscillating standing wave and associated turbulence at the free surface is considered to be the main reason for most of the defects in cast slabs made by this process.

Due to other physical factors (e.g., the slide gate and non-uniform nozzle blockage) and turbulence, the patterns on the two sides in the mold may not be symmetrical and may continuously change over time. The wave height depends upon the SEN submergence depth, as the wave is typically higher with shallow submergence. The wave height also depends on the port angle and opening area, as smaller angles and smaller area typically yield a higher wave height. Surface turbulence and standing waves are probably the most important factors affecting cast quality. The wave and recirculations oscillate from one side to another, adversely affecting the quality of the cast.

The flow is further biased due to the influence of the slide gate or preferential nozzle blockage. The biased flow increases the chances of mold flux slag entrainment. A larger jet angle downward from the horizontal helps in reducing the surface turbulence and wave height by pushing the impingement point to a lower depth in the mold. A lower impingement point, however, results in a thin solidified shell at the exit from the mold and associates itself with a danger of breakout. Another problem is that a deeper lower recirculation carries the inclusions down to much greater depth and affects the quality of cast metal.

Accordingly, it is an object of the present invention to provide an apparatus and method for continuous casting of metal that provides for a flatter and less turbulent free surface to provide effective flux flow while also allowing for more efficient removal of inclusions and allowing for potential reduction in the risk of break out. This is expected to reduce surface and subsurface defects in the cast slab associated with this surface wave and turbulence.

Although described with respect to the field of steel casting, it will be appreciated that similar advantages of surface wave damping, along with other advantages, may obtain in other applications of the present invention. Such advantages may become apparent to one of ordinary skill in the art in light of the present disclosure or through practice of the invention.

SUMMARY OF THE INVENTION

The invention includes a molten metal vessel system for casting molten metal and a method of providing a flow of molten metal for continuous casting. In general terms, the apparatus of the present invention includes a molten metal vessel system for casting molten metal, the system comprising: (a) a vessel containing a molten metal adapted to contain and dispense the molten metal for casting, the vessel having interior surfaces and the molten metal forming an upper surface; (b) a submerged entry nozzle extending below the upper surface; and (c) a flow modifier member disposed between at least one of the interior surfaces and the submerged entry nozzle. A surface flow modifier member may be used that is in sufficient proximity to the upper surface of the molten metal so as to impede the formation of waves in the upper surface of the molten metal. A submerged flow modifier member may also be used that completely submerged at some depth below the upper surface of the molten metal, and in sufficient proximity to the submerged entry nozzle to affect the upper and lower recirculating flow patterns and resulting turbulence and wave action caused thereby. The submerged flow modifier member also has the effect of attenuating standing waves at the surface of the molten metal in the continuous casting mold.

Preferably, the surface or submerged flow modifier member(s) are located on either side of the submerged entry nozzle, and a series of surface or submerged flow modifier member(s) may be used on either side of the submerged entry nozzle. The surface flow modifier member(s) typically extend into the molten metal, although they may be adapted to reside just above the free surface of the molten metal so as to impede the formation of waves in the upper metal surface. The submerged flow modifier member(s) are typically situated below the surface of the molten metal at a location to impede the upper and lower recirculating flows generated by the flow of molten metal from the submerged entry nozzle. Normally, the molten metal surface will bear a flux layer. In certain embodiments, at least a portion of the surface flow modifier member(s) or the supports therefor may extend through the flux layer and/or the molten metal. In other embodiments, the entirety of the submerged flow modifier member(s) may be located within the molten metal and below the flux layer.

In general, the invention is not limited to any geometry of the surface or submerged flow modifier member(s). For instance, in one embodiment, the surface flow modifier member(s) may be shaped so as to provide a relatively thin portion adapted to extend through the flux layer and a relatively wide portion adapted to extend into the molten metal. In another embodiment, the surface flow modifier member(s) comprise(s) a plurality of tines adapted to extend through the flux layer and a relatively wide portion adapted to extends into the molten metal. In still another embodiment, the surface flow modifier member(s) comprise (s) a lower portion being tapered away from the submerged entry nozzle and toward the interior surface, so as to be somewhat trapezoidal in shape. In alternate embodiments, wherein the flow modifier member(s) are submerged in the molten metal below the flux layer, various geometries may be employed to reduce the turbulence and wave production caused by the molten metal exiting the submerged entry nozzle. In such an embodiment, the submerged flow modifier member(s) may have, for example, a polygonal, trapezoidal, or conical geometry. It should be realized, however, that these geometries are merely examples of the various geometries that may acceptably impede turbulence and wave action according to the present invention, while allowing as much as practicable the free and uniform flow of flux on the free metal surface. As such, other geometries may also be successfully utilized for constructing a surface or submerged flow modifier member.

The surface flow modifier member may be supported in contact with or in functional proximity to the free metal surface by any appropriate mechanical means, such as through a bracket attached to the casting mold. Attachment to a structure other than the casting mold may also support the surface flow modifier member. In certain embodiments of the present invention, submerged flow modifier member (s) may be also be attached to the submerged entry nozzle. Materials and attachment protocols may be any of those appropriate for the handling of temperature resistant materials, such as refractory ceramics. It is preferred that the surface or submerged flow modifier member(s) not contact the interior mold surface to avoid disrupting both the solidification of metal and the the flow of flux into the casting mold.

Another aspect of the present invention is that the flow modifier member(s) or other turbulence and/or wave impedance means allows the submerged entry nozzle optionally to direct the flow of molten metal at an angle at or above the horizontal (rather than the typical downward angled flow). This feature helps to promote a more efficient elimination of inclusions during the casting process, and also reduces the risk of high temperature break-out in the freshly solidified layer as it emerges from the mold occasioned by the hot molten metal being directed too low and too near the downstream end of the casting mold.

The molten metal vessel system for casting molten metal of the invention also includes (a) a vessel containing a molten metal adapted to contain and dispense the molten metal for casting, the vessel having interior surfaces and the molten metal forming an upper surface; (b) a submerged entry nozzle extending below the upper surface; and (c) means for impeding the formation of waves in the upper surface of the molten metal.

The means for impedance of the formation of waves in the upper surface of the molten metal may be accomplished by application of mechanical force (such as in the form of the surface or submerged flow modifier member or equivalent mechanical arrangement or device), fluid force (such as in the form of a gaseous flow directed against the free metal surface), or through application of electromagnetic force (such as through use of electromagnetic actuators used for other purposes of controlling molten metal in the industry).

The present invention also includes a method of providing a flow of molten metal for continuous casting, the method comprising: (a) providing a vessel containing a molten metal adapted to contain and dispense the molten metal for casting, the vessel having interior surfaces and the molten metal forming an upper surface; (b) conducting a flow of molten metal below the upper surface of the molten metal while impeding the formation of waves in the upper surface of the molten metal; and (c) allowing the molten metal to exit the vessel so as to form a metal casting.

The impedance of the formation of waves in the upper surface of the molten metal may be accomplished by application of mechanical device, fluid force or electromagnetic force as described above.

The submerged entry nozzle may direct a flow of molten metal at an angle at, above, or slightly below the horizontal, although it is preferred that the angle be slightly below the horizontal, (i.e. 1–20 degrees below the horizontal).

The present invention thus provides a simple method for reducing the turbulence and wave action typically inherent to the continuous metal casting process. In one embodiment, a piece of refractory or other temperature-resistant member (referred to generally as a "surface flow modifier") is inserted, or otherwise engages the free surface, preferably from the top, and near and preferably on either side of the submerged entry nozzle. The surface flow modifier(s) then impede(s) the top recirculating flow and waves formed thereby, which in turn, significantly slows the surface velocity, and makes the free surface nearly flat. This is schematically shown in FIG. 2. In other embodiments of the present invention, a piece of refractory or other temperature-resistant member (referred to generally as a "submerged flow modifier") is located below the surface of the molten metal and provided to interrupt the normal recirculating flow pattern of molten metal from the submerged entry nozzle, thereby decreasing the magnitude of the standing waves generated thereby. Such an arrangement is illustrated in FIGS. 9 and 10. By employing the methods and apparatus of the present invention, defects caused by free surface waves or turbulence can be reduced or even practically eliminated.

Because the metal solidifies in contact with the mold wall, the surface or submerged flow modifier preferably should not touch the mold wall. Thus, it is typically necessary to maintain a gap between the surface or submerged flow modifier and the mold wall.

FIG. 3 shows a side view of the mold having a surface flow modifier as described above. This concept has been tested and proven to work in a small-scale water model. The shape, size and location of the surface flow modifier(s) will depend upon the particular system. Neither the surface or submerged flow modifier should slow down the flow to the extent that the metal freezes excessively near the free surface. A general three-dimensional schematic of the surface flow modifier system is shown in FIG. 3*a*. Since the surface flow modifier reduces the free surface turbulence, the flow becomes symmetrical on both sides of the submerged entry nozzle and significantly reduces the biased flow.

The method and apparatus of the present invention is expected to provide much better control over the continuous casting process and significantly improve the quality of the cast metal produced thereby.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE PREFERRED EMBODIMENTS

In accordance with the foregoing summary, the following presents a detailed description of the preferred embodiments, which are presently considered to include the best mode of the invention.

Figure 1:
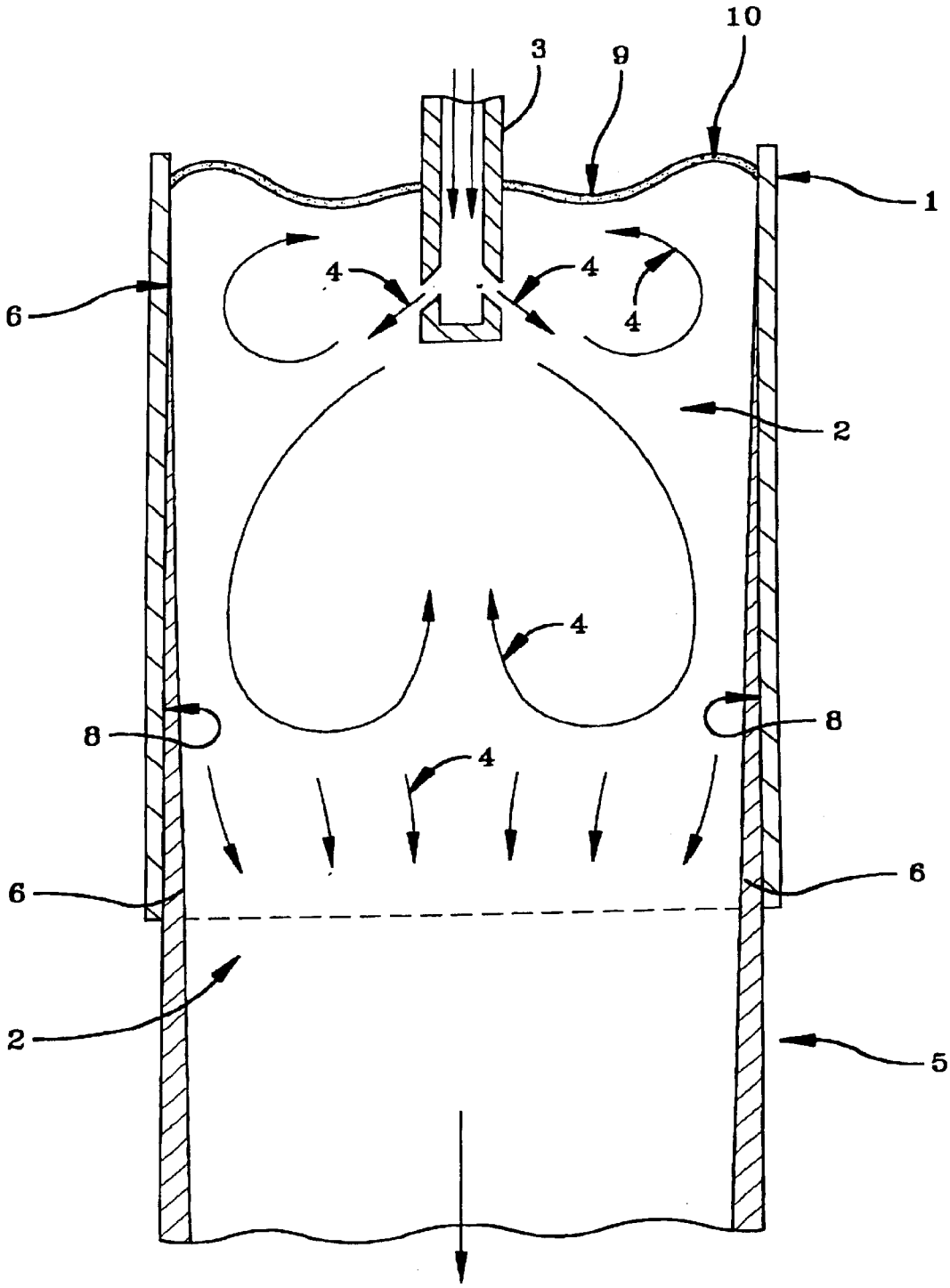
(PRIOR ART) FIG. 1
FIG. 1 shows a front sectioned elevation view of a continuous casting system showing a general flow pattern in a continuous casting mold.

FIG. 1 shows a sectioned elevation view of a continuous casting system showing a general flow pattern in a continuous casting mold. FIG. 1 shows continuous casting mold 1 and molten metal 2 entering the continuous casting mold 1 as the metal emerges from submerged entry nozzle 3. The molten metal flows generally along flow lines 4 as it enters the continuous casting mold 1, and emerges from the mold as a partially solidified slab 5 in the shape of the mold (typically rectangular). As the molten metal 2 progresses through the mold, a layer of solidified steel 6 is formed against the interior surfaces 8 of the mold 1 to make a shell over the freshly cast slab. The downward movement of the metal through the mold is facilitated by a layer of flux 9 (atop free molten metal surface 10) that extends between the interior surfaces 8 and the layer of solidified steel 6 (not shown in thickness).

Figure 2:
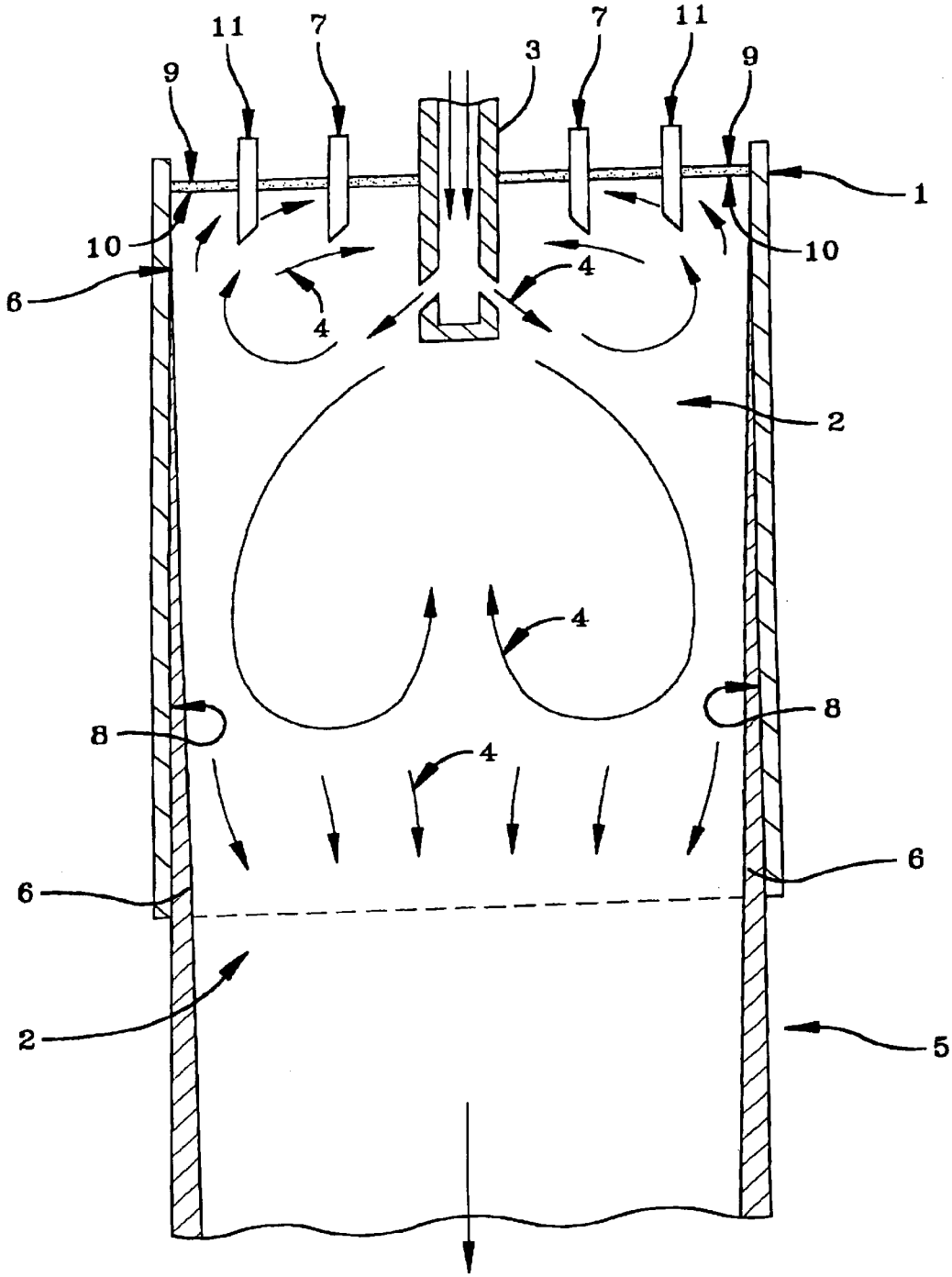
FIG. 2 shows a front sectioned elevation view of a continuous casting system showing a general flow pattern in a continuous casting mold, and showing surface flow modifiers in accordance with one embodiment of the present invention.

FIG. 2 shows a front sectioned elevation view of a continuous casting system showing a general flow pattern in a continuous casting mold, and showing a pair of surface flow modifiers 11 in accordance with one embodiment of the present invention. In an alternative embodiment of the present invention, a second pair of surface flow modifiers 7 are positioned, one on each side of the entry nozzle 3. It is appreciated that different quantities and arrangements of surface flow modifiers may be used without departing from the scope of the present invention.

FIG. 2 shows the flow lines that would cause turbulence affecting the free surface 10 of the molten metal 2 bearing flux layer 9. Surface flow modifier member 11 extends into the metal surface 10 through flux layer 9, but preferably does not touch interior surfaces, such as interior surface 8, below the level of the molten metal 2. Surface flow modifier member 11 reduces the turbulence in the molten metal 2, thus reducing wave formation in the free surface 10, while maintaining the free flow of flux material to the outer edges of the free surface 10, so that the flux can flow uniformly along the mold sides without disturbing the solidified metal layer.

Figure 2A:
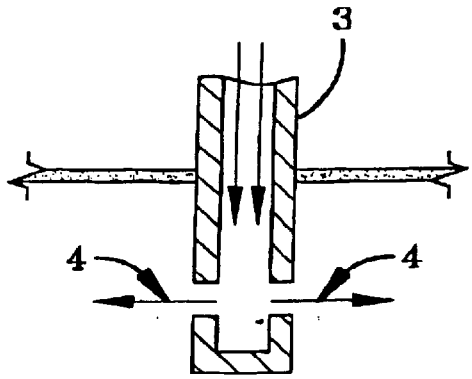
FIG. 2*a* shows an exploded view of a front sectioned elevation view of the submerged entry nozzle having horizontal molten metal discharge in accordance with one embodiment of the present invention.

FIG. 2*a* shows an exploded view of an alternative embodiment of the submerged entry nozzle 3. In the embodiment depicted in FIG. 2*a*, the ports of the submerged entry nozzle are adapted to cause the molten metal to exit the nozzle in a substantially horizontal direction 4.

Figure 2B:
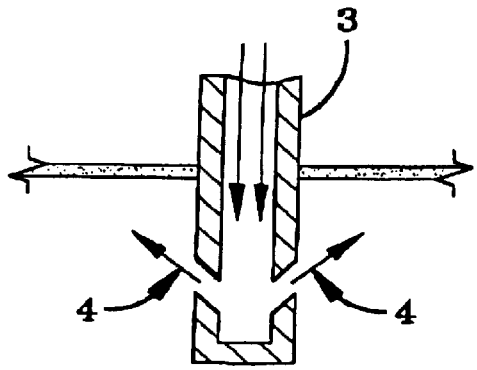
FIG. 2*b* shows an exploded view of a front sectioned elevation view of the submerged entry nozzle having an upwardly flowing molten metal discharge in accordance with one embodiment of the present invention.

FIG. 2*b* shows an exploded view of another alternative embodiment of the submerged entry nozzle 3. In the embodiment depicted in FIG. 2*b*, the opening of the submerged entry nozzle is adapted to cause the molten metal to exit the nozzle in an upward direction 4 from the horizontal.

Figure 2C:
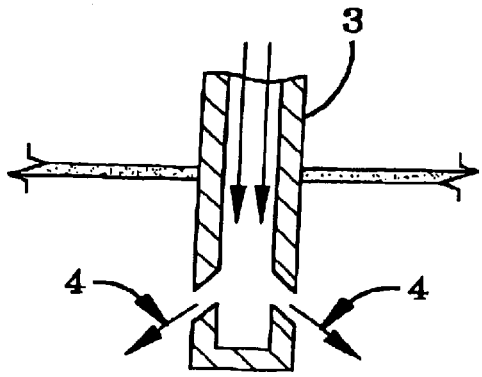
FIG. 2*c* shows a front sectioned elevation view of a continuous casting system showing a general flow pattern in a continuous casting mold, and showing an outwardly tapered surface flow modifier in accordance one embodiment of the present invention.

FIG. 2*c* shows a front-sectioned elevation view of a continuous casting system depicting another alternative embodiment of the surface flow modifier 11. As depicted in FIG. 2*c*, the surface flow modifiers 11 are each adapted to have a lower portion 16, the lower portion being outwardly extending away from the entry nozzle 3.

Figure 3:
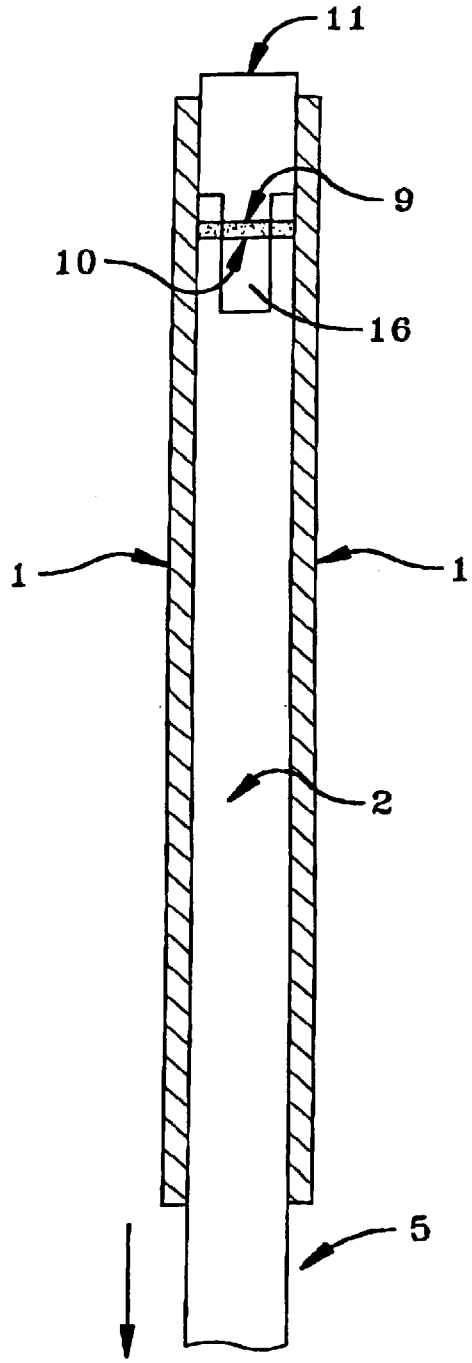
FIG. 3 shows a side view schematic of a continuous casting system showing a general flow pattern in a continuous casting mold, and showing a surface flow modifier in accordance with one embodiment of the present invention.

FIG. 3 shows a side sectioned elevation view of the continuous casting system of FIG. 2. FIG. 3 shows the surface flow modifier member 11 in its position attached to the sides of mold 1. As can be seen from FIG. 3, the surface flow modifier member 11 is adapted to have a lower portion 16, the lower portion 16 being of sufficient length so as to cause it to be extended through the flux layer 9 and submersed in the molten metal 2. The lower portion 16 of the surface flow modifier member 11 is further adapted to be sufficiently narrow so as to maintain a space between the outer edges of the lower portion 16 and the interior surface 8 of the continuous casting mold 1. Maintaining a space between the lower portion and interior surface 8 of the mold allows greater continuity of the flux layer 9 as it flows atop the molten metal surface 10, without attendant disruption of the solidifying metal.

Figure 3A:
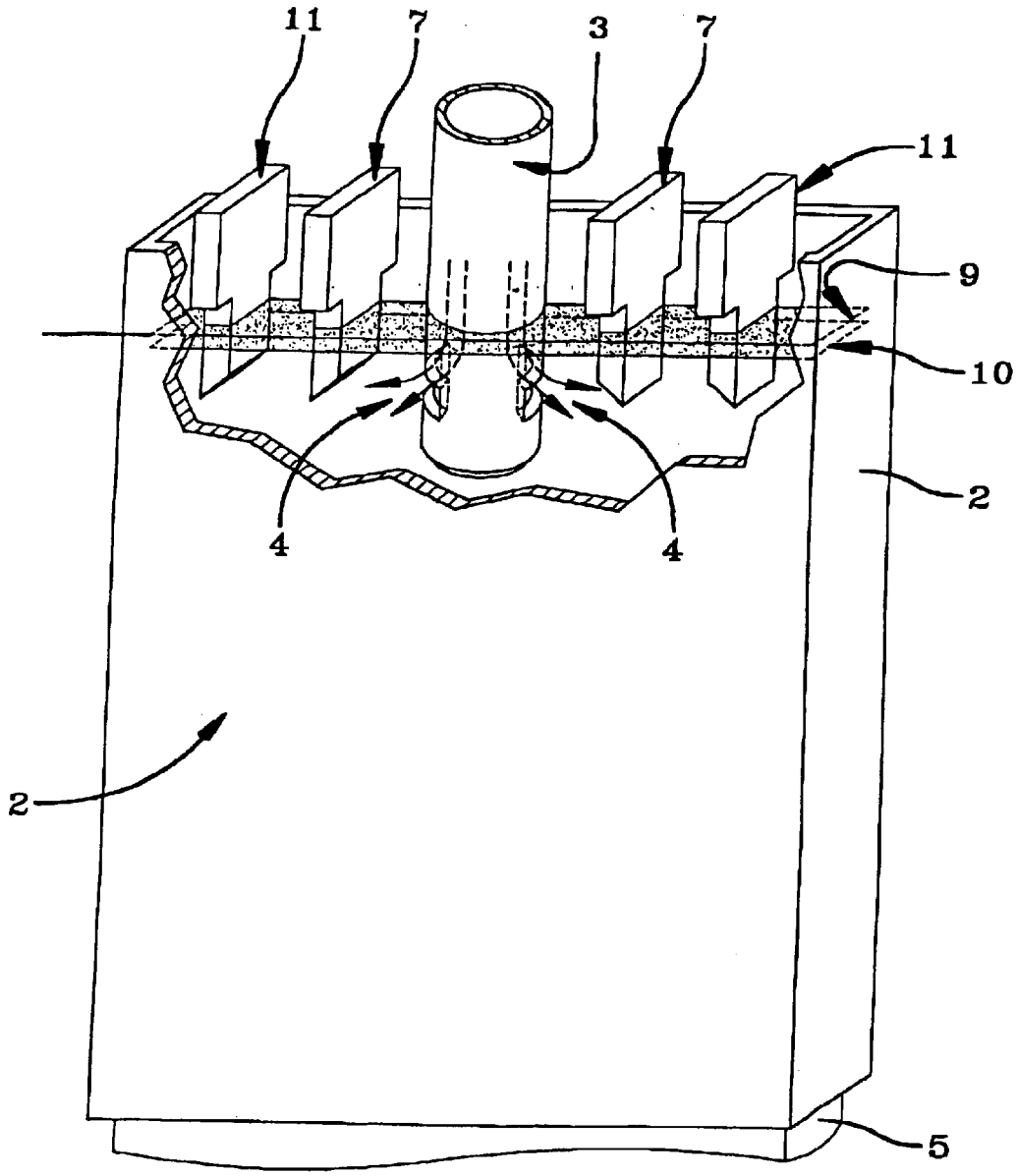
FIG. 3*a* shows a perspective view schematic of a continuous casting system showing a general flow pattern in a continuous casting mold, and showing at least one surface flow modifier in accordance with one embodiment of the present invention.

FIG. 3*a* shows a perspective view of the continuous casting system of FIG. 2. FIG. 3*a* also depicts the additional surface flow modifiers 7 of an alternative embodiment.

Figure 4:
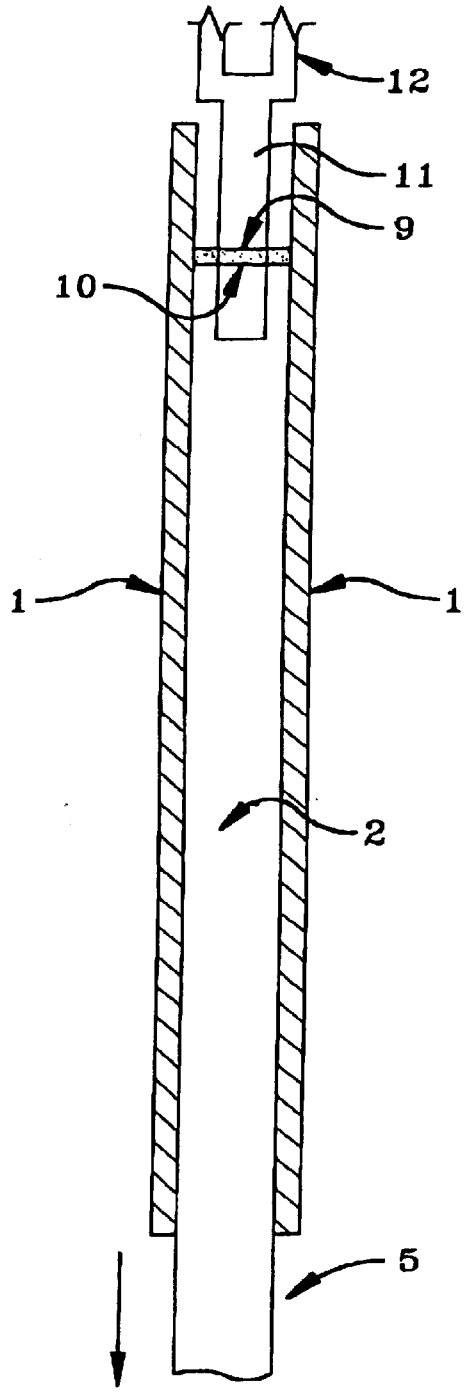
FIG. 4 shows a side view schematic of a continuous casting system showing a continuous casting mold, and showing an externally supported surface flow modifier in accordance with one embodiment of the present invention.

FIG. 4 shows a side sectioned elevation view of an alternative embodiment of the continuous casting system of FIG. 2. As can be seen in FIG. 4, the surface flow modifier 11 is adapted to be externally supported, the surface flow modifier 11 having an upper portion 12, the upper portion 12 being affixed to any suitable, dimensionally stable external member. It is appreciated that in this alternative embodiment, a plurality of differently shaped surface flow modifiers can be adapted to be externally supported.

Figure 5:
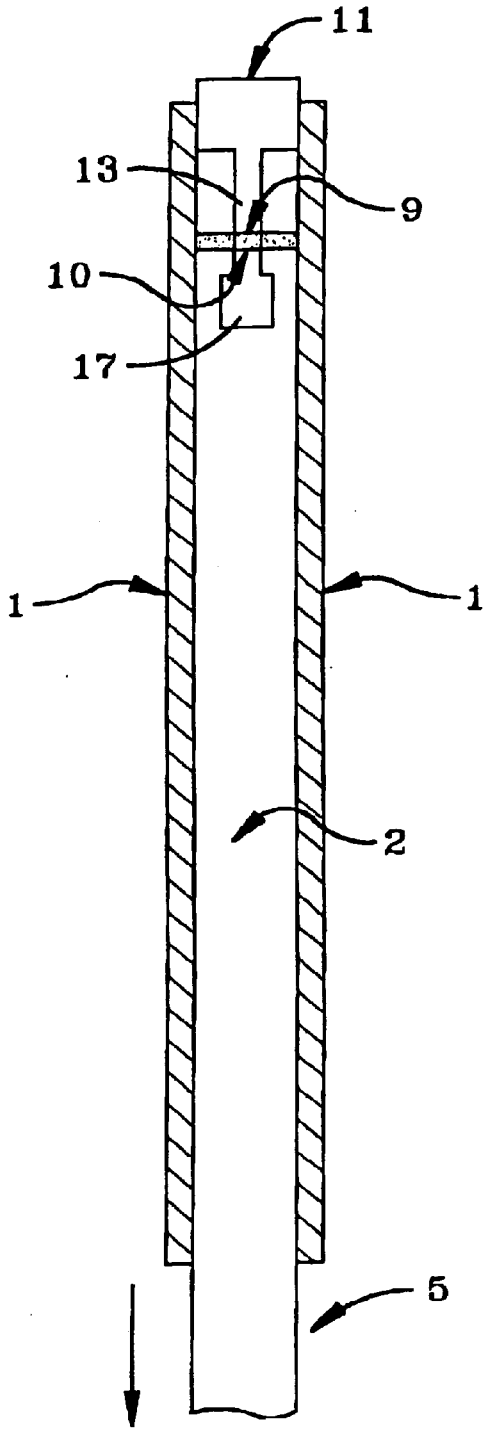
FIG. 5 shows a side view schematic of a continuous casting system showing a continuous casting mold, and showing a paddle shaped surface flow modifier in accordance with one embodiment of the present invention.

FIG. 5 shows a side sectioned elevation view of another alternative embodiment of the continuous casting system of FIG. 2. As can be seen in FIG. 5, the surface flow modifier 11 is adapted to have a relatively thin portion 13, the relatively thin portion 13 being adapted to extend through the flux layer 9 and into the molten metal 2. The surface flow modifier 11 is further adapted to have a relatively wide portion 17, the relatively wide portion 17 being permanently affixed to the relatively thin portion 13. In the alternative embodiment depicted, the surface flow modifier 11 is positioned so that the relatively wide portion 17 is completely submersed in the molten metal 2.

Figure 6:
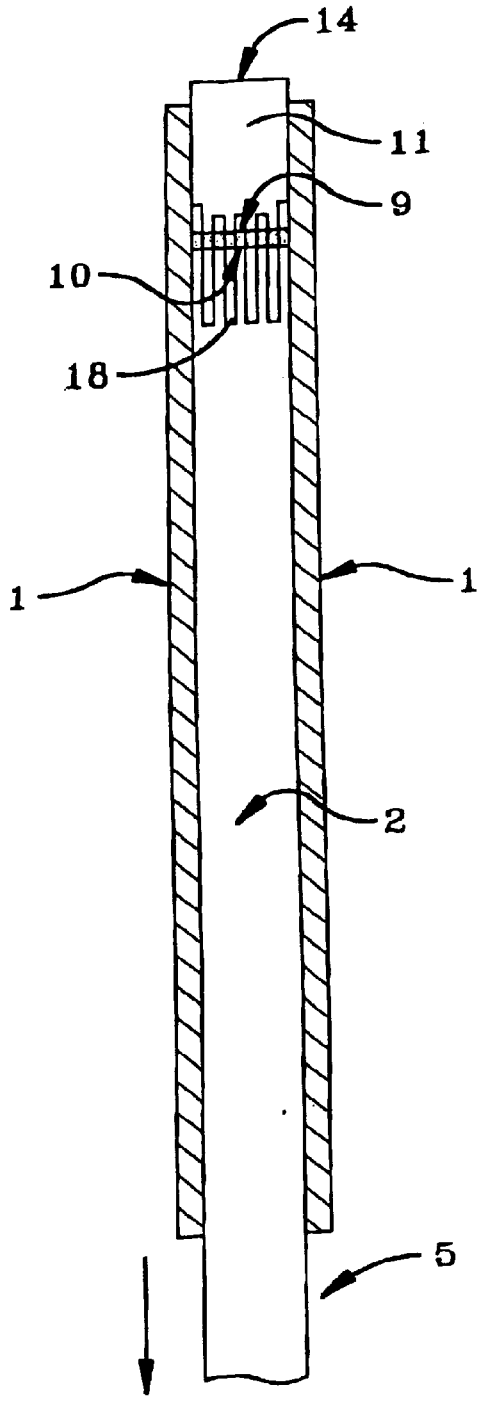
FIG. 6 shows a side view schematic of a continuous casting system showing a continuous casting mold, and showing a surface flow modifier having a plurality of tines in accordance with one embodiment of the present invention.

FIG. 6 shows a side sectioned elevation view of another alternative embodiment of the continuous casting system of FIG. 2. As can be seen in FIG. 6, the surface flow modifier 11 is adapted to have a plurality of tines 18, the tines being adapted so that the upper portion of the tines is above the flux layer 9 and the lower portion extends through the flux layer 9 and into the molten metal 2.

Figure 7:
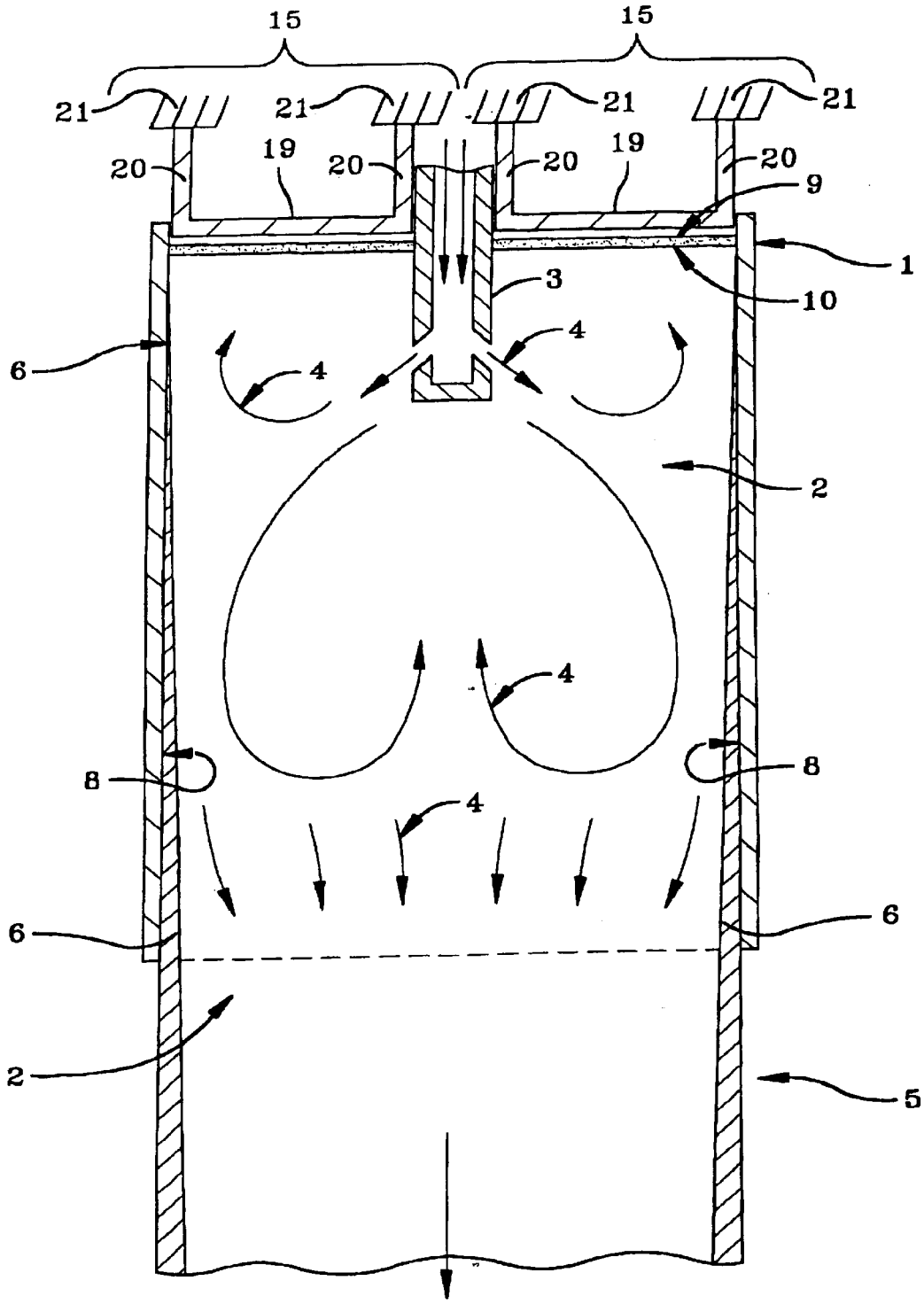
FIG. 7 shows a front-sectioned elevation view of a continuous casting system showing a continuous casting mold, and showing a surface flow modifier member in accordance with one embodiment of the present invention.

FIG. 7 shows a front-sectioned elevation view of a continuous casting system depicting another alternative embodiment of the present invention. The surface flow modifiers, as depicted in FIG. 2, are replaced with surface flow modifier members 15. As depicted in FIG. 7, there is a surface flow modifier member positioned on either side of the submerged entry nozzle 3 and between the submerged entry nozzle 3 and inner wall 8 of the mold 1. The surface flow modifier members 15 are positioned sufficiently close to the flux layer 9 so as to make contact with the flux layer 9, the surface flow modifier members 15 being further adapted not to extend through the flux layer 9. The surface flow modifier members 15 being U-shaped in cross section and having a lower contact portion 19 having a sufficiently flat planar surface for clipping waves as they are formed on the free surface 10 of the molten metal 2.

In FIG. 7, the surface flow modifier members 15 are adapted to have a support portion 20, the support portion 20 being adapted so as to be capable of being permanently affixed to external support members 21. The external support members 21 comprising any dimensionally stable external support means.

Figure 8:
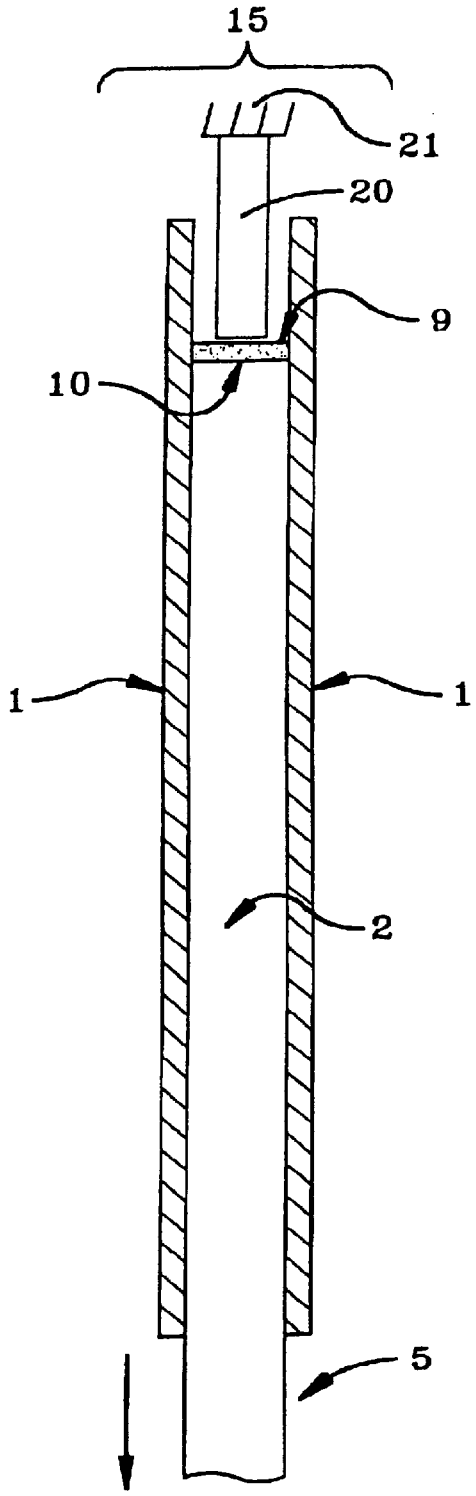
FIG. 8 shows a side view schematic of a continuous casting system showing a continuous casting mold, and showing a surface flow modifier member in accordance with one embodiment of the present invention.

FIG. 8 shows a side sectioned elevation view of the continuous casting system of FIG. 7 having the surface flow modifier members 15 instead of the surface flow modifiers of FIG. 2. As can be seen in FIG. 8, the sides of the surface flow modifier member 15 are positioned so as to be sufficiently close but not in contact with the sides of the mold 1.

Figure 9A:
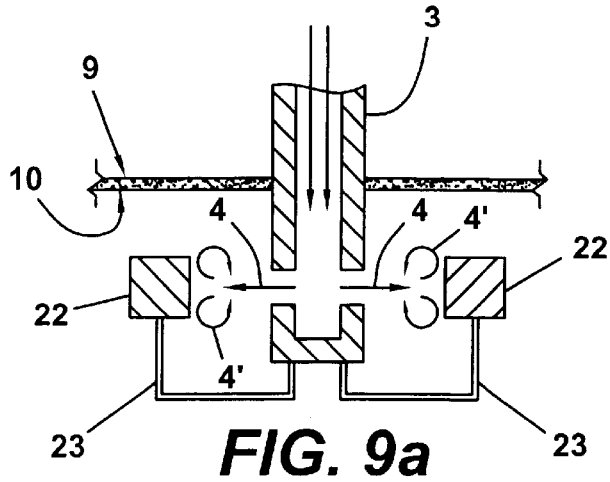
FIGS. 9*a*–9*c* consist of exploded views, in partial cross-section, of an alternate embodiment of the present invention, wherein submerged flow modifier members are used to modify a flow of molten metal from the submerged entry nozzle of FIG. 2*a*.
Figure 9B:
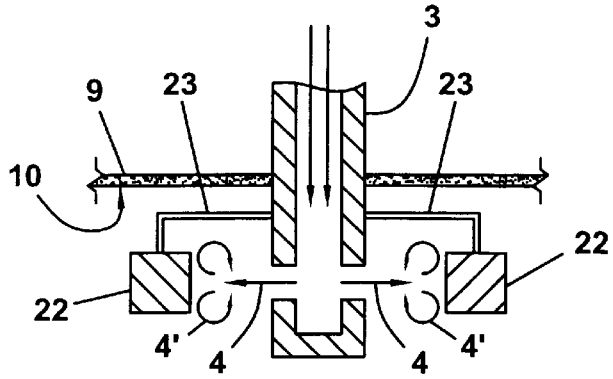
Figure 9C:
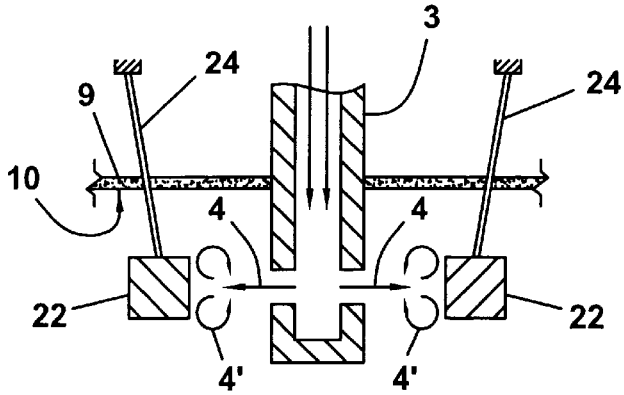

An alternate embodiment of the present invention can be observed by reference to FIGS. 9*a*–9*c*. In this particular embodiment, submerged flow modifiers 22 reside below the free surface 10 of the molten metal 2 and below the flux layer 9. A submerged flow modifier 22 is placed on either side of the submerged entry nozzle 3 and is located to modify the natural flow 4 of the molten metal 2 therefrom. As can be seen by a comparison to FIG. 1, the submerged flow modifiers 22 inhibit the severity of the upward and downward recirculating flow patterns 4' that are generally produced by the submerged entry nozzle in a continuous casting process, even when the molten metal flow 4 is directed at a less than optimum, substantially horizontal angle from the submerged entry nozzle 3.

The position of the submerged flow modifiers 22 may be secured by various means. As shown in FIGS. 9*a* and 9*b*, the submerged flow modifiers 22 may be affixed to a portion of the submerged entry nozzle 3 by any suitable attachment means 23 that is capable of withstanding the high temperature of the molten metal 2. For example, high melting point steel or ceramic brackets may be utilized. As depicted in FIG. 9*c*, it is also possible to secure the position of the submerged flow modifiers 22 by attachment thereof to a sufficiently stable support member 24 residing above the free surface 10 of the molten metal 2. In each of these cases, it is preferred, for the reasons discussed above, that a gap be maintained between the interior surfaces 8 of the mold 1 and the submerged flow modifiers 22.

Figure 10A:
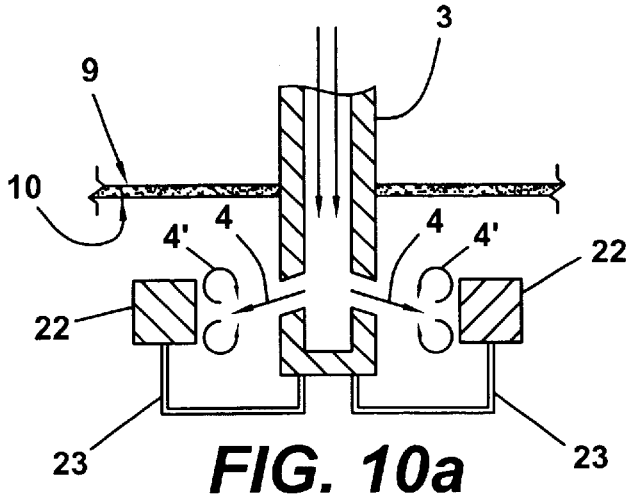
FIGS. 10*a*–10*c* illustrate the submerged flow modifier members of FIGS. 9*a*–9*c* being used to modify a flow of molten metal from the submerged entry nozzle of FIG. 2*c*.
Figure 10B:
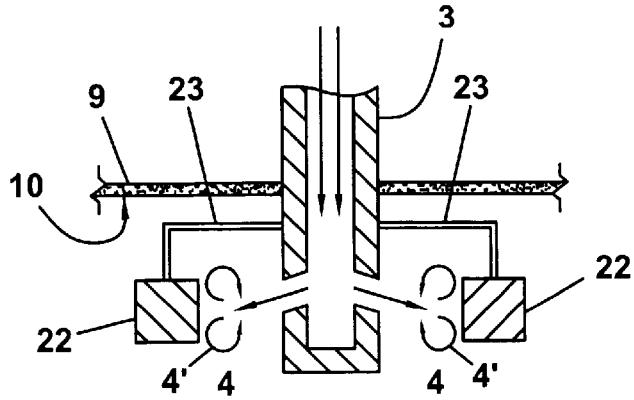
Figure 10C:
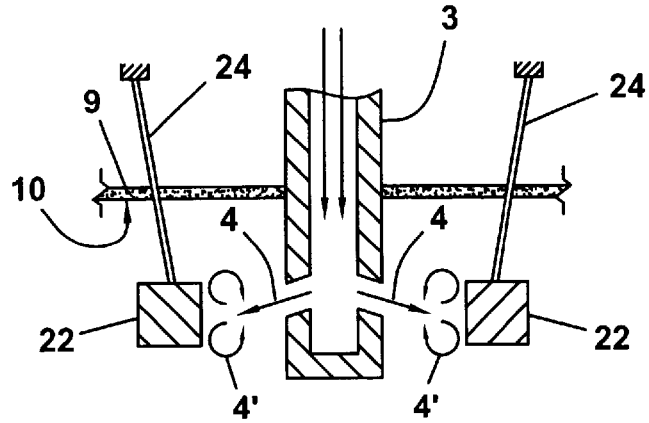

Still another embodiment of the present invention is illustrated in FIGS. 10*a*–10*c*. This embodiment of the present invention utilizes the submerged flow modifiers 22 and attachment means 23 of FIGS. 9*a*–9*c*, but the submerged entry nozzle 3 of FIG. 2*c*. As stated previously, in order to minimize standing waves and turbulence, it is generally preferable to provide a slightly downward flow path 4 for the molten metal flowing from the submerged entry nozzle 3. FIGS. 10*a*–10*c* show that the submerged flow modifiers 22 of the present invention can also be used with equal or greater effect with this form of submerged entry nozzle 3. In a manner similar to the operation of the submerged flow modifiers 22 of FIGS. 9*a*–9*c*, the submerged flow modifiers 22 of FIGS. 10*a*–10*c* are able to beneficially modify the flow of the molten metal exiting the submerged entry nozzle 3 so that the natural recirculating flow patterns of the molten metal are reduced, and turbulence and standing waves are diminished in severity, or even practically eliminated.

The submerged flow modifiers 22 of FIGS. 9*a*–9*c* and 10*a*–10*c* are shown to be of substantially square cross-section. However, it should be realized that a multitude of geometries may be employed when constructing submerged flow modifiers 22 for use according to the principles of the present invention. For example, the submerged flow modifiers 22 may be polygonal, trapezoidal, cylindrical, spherical, conical, or practically any other shape that beneficially alters the flow 4 of molten metal from the submerged entry nozzle 3 and reduces or eliminates turbulence or standing waves. The submerged flow modifiers 22 are also not limited to a particular size, but rather should be selected based on the particular application to which they will be applied. Similarly, depending on the parameters of the application, the exact position of the submerged flow modifiers 22 in relation to the submerged entry nozzle 3 and the free surface 10 of the molten metal may be altered to give the best results. For example, although the submerged flow modifiers 22 are shown to reside entirely below the upper surface 10 of the molten metal 2 and below the flux layer 9, it is also possible that a portion of the submerged flow modifiers may contact the flux layer and/or the upper surface of the molten metal.

It is also contemplated that the submerged flow modifiers 22 may perform additional functions. For example, certain sensors or other devices may be attached to or housed in the submerged flow modifiers 22. These sensors and devices may include, for purposes of illustration, means for performing temperature monitoring, oxygen sensing, and for determining and controlling the level of molten metal in the mold. Such sensors or devices may be used individually or, alternatively, may be used in various combinations. The sensors and/or other devices may be further connected to external equipment, such as through special conduits or through the means employed to secure the position of the submerged flow modifiers 22.

It should also be realized by one skilled in the art that submerged flow modifiers 22 of differing geometries may be employed to act on a single submerged entry nozzle 3. The scope of the present invention is also not limited to a particular number of submerged flow modifiers 22 that can be used in a single application one, or a number of submerged flow modifiers may be utilized to alter the flow 4 of the molten metal. It is also contemplated that the submerged flow modifiers 22 can be used with the surface flow modifiers 11 described above to further reduce turbulence and standing waves. Any combination of submerged flow modifiers 22 and standing wave modifiers 11 may be utilized to produce the desired results.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, it will be within the ability of one of ordinary skill in the art to make alterations or modifications to the present invention, such as through the substitution of equivalent materials or structural arrangements, or through the use of equivalent process steps, so as to be able to practice the present invention without departing from its spirit as reflected in the appended claims, the text and teaching of which are hereby incorporated by reference herein. It is the intention, therefore, to limit the invention only as indicated by the scope of the claims and equivalents thereof.

What is claimed is:

1. A molten metal vessel system for casting molten metal, said system comprising:

(a) a vessel containing a molten metal and adapted to contain and dispense said molten metal for casting, said vessel having interior surfaces defining an inner width and said molten metal forming an upper metal surface;

(b) a submerged entry nozzle extending below said upper metal surface, said submerged entry nozzle having at least one discharge orifice for dispensing molten metal into said vessel; and (c) at least one flow modifier member extending through said upper metal surface disposed between at least one of said interior surfaces and said submerged entry nozzle, at least a portion of each flow modifier member being sufficiently wide enough to span said inner width of said vessel without touching said interior surfaces below said upper metal surface, each said flow modifier member being opposite or below said at least one discharge orifice so as to impede the formation of waves in said upper surface of said molten metal without slowing down flow of molten metal to an extent where the metal freezes at or near the metal surface.

2. A molten metal vessel system according to claim 1 having at least one submerged flow modifier member on either side of said submerged entry nozzle.

3. A molten metal vessel system according to claim 1 wherein said at least one submerged flow modifier member is supported by attachment to said submerged entry nozzle.

4. A molten metal vessel system according to claim 1 wherein said at least one submerged flow modifier member is supported by attachment to a support member that resides above said upper metal surface.

5. A molten metal vessel system according to claim 4 wherein the means for attaching said submerged flow modifier to said support member passes through said upper metal surface and acts as a surface flow modifier.

6. A molten metal vessel system according to claim 1 wherein said molten metal surface comprises a flux layer and wherein a portion of said at least one submerged flow modifier member contacts said flux layer.

7. A molten metal vessel system according to claim 1 wherein, said submerged flow modifier is adapted to monitor the temperature of the molten metal.

8. A molten metal vessel system according to claim 1 wherein, said submerged flow modifier is adapted to monitor the level of molten metal in said vessel.

9. A molten metal vessel system according to claim 1 wherein, said submerged flow modifier is adapted to monitor the level of oxygen in said molten metal.

10. A molten metal vessel system according to claim 1, wherein said submerged flow modifier is used in conjunction with at least one surface flow modifier.

11. A molten metal vessel system according to claim 1, wherein said submerged flow modifier is of polygonal cross-section.

12. A molten metal vessel system according to claim 1, wherein said submerged flow modifier is of trapezoidal cross-section.

13. A molten metal vessel system according to claim 1, wherein said submerged flow modifier is of circular cross-section.

14. A molten metal vessel system according to claim 1, wherein said submerged flow modifier is of a conical shape.

15. A molten metal vessel system according to claim 1 wherein said submerged entry nozzle is adapted to direct a flow of molten metal at an angle at, above, or slightly below horizontal.

16. A molten metal vessel system for casting molten metal, said system comprising:

(a) a vessel containing a molten metal adapted to contain and dispense said molten metal for casting, said vessel having interior surfaces defining an inner width and said molten metal forming an upper metal surface;

(b) a submerged entry nozzle extending below said upper metal surface, said submerged entry nozzle having at least one discharge orifice for providing a supply of said molten metal to said vessel; and (c) at least one submerged flow modifier member extending through said upper metal surface and disposed between at least one of said interior surfaces and said submerged entry nozzle and positioned in the path of a flow of said molten metal exiting said submerged entry nozzle, at least a portion of each flow modifier member being sufficiently wide enough to span said inner width of said vessel without touching said interior surfaces below said upper metal surface, each said flow modifier member being opposite or below said at least one discharge orifice so as to alter the natural flow pattern of said molten metal within said vessel, thereby reducing turbulence within the molten metal and impeding the formation of waves in said upper surface of said molten metal without slowing down flow of molten metal to an extent where the metal freezes at or near the metal surface.

17. A method of improving the quality of a continuous metal casting process, said method comprising:

(a) providing a vessel containing a molten metal and adapted to contain and dispense said molten metal for casting, said vessel having interior surfaces defining an inner width and said molten metal forming an upper surface;

(b) conducting a flow of molten metal below said upper surface of said molten metal using submerged entry nozzle having at least one discharge orifice for discharging molten metal into said vessel;

(c) providing at least one flow modifier extending through said upper metal surface, at least a portion of each said flow modifier member being sufficiently wide enough to substantially span said inner width of said vessel without touching said interior surfaces below said upper metal surface, each said flow modifier member being positioned between said interior surfaces and said submerged entry nozzle opposite or below said at least one discharge orifice; and (d) using said at least one flow modifier to alter the natural flow pattern of said molten metal within said vessel such that the turbulence within said molten metal is reduced and the formation of waves in said upper surface of said molten metal is impeded without slowing down flow of molten metal to an extent where the metal freezes at or near the metal surface; and (e) allowing said molten metal to exit said vessel so as to form a metal casting.

18. A method according to claim 17 wherein at least one submerged flow modifier is supported by attachment to said submerged entry nozzle.

19. A method according to claim 17 wherein at least one submerged flow modifier is supported by attachment to a support member that resides above said upper surface of said molten metal.

20. A method according to claim 19 wherein the means used to secure said submerged flow modifier to said support member passes through said upper surface of said molten metal and acts as a surface flow modifier.

21. A method according to claim 19 wherein one or more surface flow modifiers are used in conjunction with said at least one submerged flow modifier.

22. A method according to claim further comprising locating one or more sensors in or on said at least one submerged flow modifier.

23. A method according to claim 22 wherein a sensor monitors the temperature of said molten metal.

24. A method according to claim 22 wherein a sensor monitors the oxygen level of said molten metal.

25. A method according to claim 22 wherein said sensor monitors the level of said molten metal in said vessel.

26. A method according to claim 19 wherein said molten metal is directed by said subsurface entry nozzle at an angle at, above, or slightly below a line normal to the horizontal.

* * * * *